US010588384B2

(12) United States Patent
Dos Santos Pedrosa

(10) Patent No.: US 10,588,384 B2
(45) Date of Patent: Mar. 17, 2020

(54) DEVICE FOR THE COMFORT-ADJUSTMENT OF THE LENGTH OF A BRACELET

(71) Applicant: ROLEX SA, Geneva (CH)

(72) Inventor: Pedro Manuel Dos Santos Pedrosa, Prévessin-Moens (FR)

(73) Assignee: ROLEX SA, Geneva (CH)

( * ) Notice: Subject to any disclaimer, the term of this patent is extended or adjusted under 35 U.S.C. 154(b) by 4 days.

(21) Appl. No.: 15/830,711

(22) Filed: Dec. 4, 2017

(65) Prior Publication Data

US 2018/0153268 A1 Jun. 7, 2018

(30) Foreign Application Priority Data

Dec. 5, 2016 (EP) ..... 16202133

(51) Int. Cl.
*A44C 5/24* (2006.01)

(52) U.S. Cl.
CPC ..... *A44C 5/246* (2013.01)

(58) Field of Classification Search
CPC ..... A44C 5/246; Y10T 24/2155
See application file for complete search history.

(56) References Cited

U.S. PATENT DOCUMENTS 2,997,761 A 8/1961 Davis
5,038,557 A * 8/1991 Otsuki ..... A44C 5/107 59/80
5,689,861 A * 11/1997 Petignat ..... A44C 5/2042 24/265 B
5,771,543 A 6/1998 Froidevaux et al.
(Continued)

FOREIGN PATENT DOCUMENTS

CH 702 524 A2 7/2011
EP 0 819 391 A1 1/1998
(Continued)

OTHER PUBLICATIONS

European Search Report and Written Opinion dated Apr. 24, 2017 issued in European application No. EP16202129, counterpart of co-pending U.S. Appl. No. 15/830,703; w/ English partial translation and partial machine translation (13 pages).
(Continued)

*Primary Examiner* — Robert Sandy
*Assistant Examiner* — Louis A Mercado
(74) *Attorney, Agent, or Firm* — Seckel IP, PLLC

(57) ABSTRACT

Device for adjusting the length of a bracelet, including at least one adjusting link element (23) mounted with the ability to rotate about a first axis (A1), the adjusting link element (23) being connected to an end link element (25) of a bracelet by a connecting pin (26), so that the end link element (25) can occupy two positions, each of these two positions respectively corresponding to a short and long configuration of the length of the bracelet, and wherein the bracelet length adjustment device includes an elastic fastening device so as to elastically fasten together the at least one adjusting link element (23) and the end link element (25) in the short configuration, in which configuration the elastic fastening device is arranged around a third axis (A3) that is not aligned with the first axis (A1).

20 Claims, 5 Drawing Sheets

(56) References Cited

U.S. PATENT DOCUMENTS 6,026,637 A * 2/2000 Dombre ..... A44C 5/107 59/80
6,073,316 A * 6/2000 Ferrario ..... A44C 5/24 24/71 J
6,094,782 A * 8/2000 Gay ..... A44C 5/24 24/68 J
6,098,394 A * 8/2000 Hashimoto ..... G04B 37/1486 59/80
6,119,315 A * 9/2000 Gay ..... A44C 5/24 24/265 WS
6,185,799 B1 * 2/2001 Gay ..... A44C 5/24 24/715
6,401,307 B1 6/2002 Wild
6,488,404 B2 * 12/2002 Zurcher ..... A44C 5/107 368/282
6,494,030 B2 * 12/2002 Cazard ..... A44C 5/107 59/80
7,043,895 B2 * 5/2006 Mace ..... A44C 5/107 59/80
7,303,330 B2 * 12/2007 Hartzband ..... A44C 5/107 224/164
8,001,658 B2 * 8/2011 Christian ..... A44C 5/246 24/265 WS
8,418,325 B2 * 4/2013 Lemosquet ..... A44C 5/2042 24/265 WS
8,739,369 B2 * 6/2014 Kaltenrieder ..... A44C 5/24 24/265 WS
8,789,245 B2 * 7/2014 Leger ..... A44C 5/246 24/265 WS
8,910,348 B2 * 12/2014 Schenk ..... A44C 5/246 24/71 J
9,049,906 B2 6/2015 Schmidt et al.
9,282,792 B2 * 3/2016 Mace ..... A44C 5/24
9,635,911 B2 5/2017 Moille
2006/0090305 A1 5/2006 Aquillon et al.
2007/0125123 A1 6/2007 Sierro
2008/0083101 A1 4/2008 Christian et al.
2014/0101893 A1 4/2014 Dornhege

FOREIGN PATENT DOCUMENTS

EP 1 790 247 A1 5/2007
EP 1 908 366 A1 4/2008
EP 2 601 855 A1 6/2013

OTHER PUBLICATIONS

European Search Report and Written Opinion dated Apr. 12, 2017 issued in counterpart application No. EP16202133; w/ English partial translation and partial machine translation (15 pages).
Office Action dated Sep. 3, 2019 in co-pending U.S. Appl. No. 15/830,703 (with PTO892, without returned SB08) (total 12 pages).

* cited by examiner

DEVICE FOR THE COMFORT-ADJUSTMENT OF THE LENGTH OF A BRACELET

INTRODUCTION

This application claims priority of European patent application No. EP16202133.1 filed Dec. 5, 2016, the content of which is hereby incorporated by reference herein in its entirety.

The present invention relates to a device for the comfort-adjustment of the length of a bracelet, particularly suited to an arrangement within a deployment clasp fitted between two ends of the bracelet. It also relates to a clasp and to a bracelet per se, incorporating such a length-adjustment device, and to a wristwatch per se comprising such a device.

PRIOR ART

There are several situations in which it is necessary to perform adjustment functions involving guidance and fastening functions on a bracelet, notably a wristwatch.

For example, a clasp is generally provided with a first adjustment of its position relative to a bracelet, particularly relative to one band of the bracelet, referred to as the conventional adjustment, which allows a first adjustment of the length of the bracelet, notably during the operation of assembling the bracelet. However, the final length obtained for the bracelet may prove not to be optimal.

For that reason, existing clasps are equipped with a solution that allows a small second adjustment to be made to the length of the bracelet, this also being referred to as a comfort adjustment, to complement the conventional first adjustment. Document EP0819391 describes such a solution, which relies on an adjusting link which pivots and can occupy two stable positions that impose two different lengths on the bracelet. The short position is maintained by a notch of an end link element of the bracelet which catches and elastically immobilizes against the adjusting link in its short position. Such a solution therefore requires the articulation of several links and the fastening of a link element in order to guarantee stability in the short position. In such a solution, the adjusting link comprises two parallel transverse pins: the first transverse pin is intended for fixing to the clasp, to guide the pivoting of the adjusting link relative to the clasp, and the second transverse pin is intended for an articulated connection with an end link element of the bracelet. Thus, such a solution ultimately allows comfort adjustment the length of which is defined by the distance between the two parallel transverse pins, namely substantially twice this distance. This minimum distance is imposed by constraints of construction of the adjusting link, the pins of which have a minimal diameter dictated by mechanical considerations, and the bores that accommodate these two pins likewise have a minimal spacing dictated by mechanical considerations. Finally, it is found that such a comfort adjustment device in practice uses a minimal length adjustment of the order of 5 mm. Now, it could be advantageous to obtain a shorter length adjustment for this comfort adjustment, in order to perform a fine adjustment, or even a very fine adjustment, something which is not possible with such a solution of the prior art because of the construction constraints explained hereinabove. Such an adjustment would make it possible to better address potential variations in wrist diameter.

It is an overall objective of the invention to offer a solution for the fine or even very fine adjustment of the length of a bracelet while at the same time optimizing the two, guidance and fastening, functions involved.

More particularly, a first object of the invention to offer a guidance and fastening solution for a bracelet, which makes it possible to perform a function of very small-scale adjustment of the length of a bracelet.

A second object of the invention is to offer a solution for adjusting the length of a bracelet, which is reliable in its operation and convenient to manipulate.

A third object of the invention is to offer a solution for adjusting the length of a bracelet, which guarantees the aesthetic integrity of a bracelet.

BRIEF DESCRIPTION OF THE INVENTION

To this end, the invention relies on a device for adjusting the length of a bracelet, wherein it comprises at least one adjusting link element mounted with the ability to rotate about a first axis, the adjusting link element being connected to an end link element of a bracelet by a connecting pin, so that the end link element can occupy two positions, each of these two positions respectively corresponding to a short and long configuration of the length of the bracelet, and wherein the bracelet length adjusting device comprises an elastic fastening device so as to elastically fasten together the at least one adjusting link element and the end link element in the short configuration, in which configuration the elastic fastening device is arranged around a third axis that is not aligned with the first axis.

The invention is more specifically defined by the claims.

BRIEF DESCRIPTION OF THE FIGURES

These objectives, features and advantages of the invention will be described in detail in the following description of particular nonlimiting embodiments given with reference to the appended figures, in which.

For the sake of simplicity, the description will, by convention, use the terms "longitudinal direction" to denote the direction along the length of a bracelet band or of a clasp, and "transverse or transversal direction" to denote the perpendicular direction, in the plane of a bracelet band (across its width) or of a clasp. The vertical direction is the direction perpendicular to the first two directions, oriented perpendicular to the plane of the bracelet. Furthermore, the term "link element" will be used for an elementary component of a bracelet and the term "link" will be used for a collection of link elements. "Bracelet" will be used to denote either the bracelet in its entirety, with or without the clasp, or one or other of the bands of the bracelet. Furthermore, references used to denote elements that are identical or similar or that offer the same functions as given references will be followed by a "'" symbol.

Figure 1:
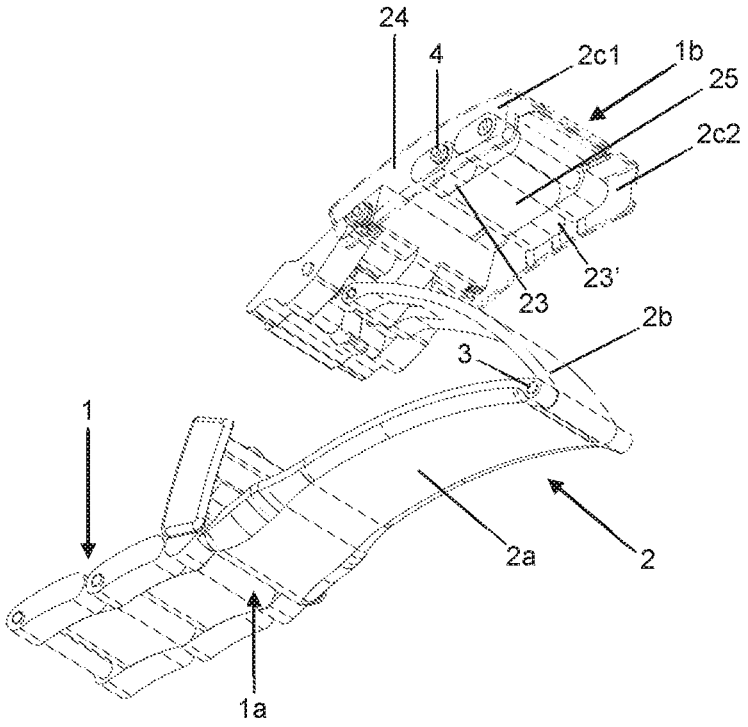
FIG. 1 depicts a perspective view of a clasp incorporating a bracelet length adjusting device according to one embodiment of the invention.

The embodiment of the invention relies on a device for adjusting the length of a bracelet, notably a device for adjusting the length of a bracelet within a clasp, as depicted in FIG. 1. Such a bracelet length adjustment device requires the implementation of guidance and fastening functions and comprises at least one guidance device and one elastic fastening device.

In this embodiment, the end 1*b* of one band of a bracelet is connected to a device for adjusting the length of a bracelet, which is intended for a comfort adjustment of the length of the bracelet: it is therefore configured to allow a small-scale modification to the length of the bracelet, in addition to a conventional initial adjustment, as explained earlier.

This embodiment is incorporated into a deployment clasp 2 comprising two leaves 2*a*, 2*b*, articulated to one another about a pin 3. One of these leaves, the leaf 2*a*, is articulated to a first end 1*a* of a bracelet 1, whereas the other end 1*b* of this bracelet is articulated to a cover 24 of the clasp provided with two parallel lateral walls 2*c*1, 2*c*2, forming a cap under which the leaves 2*a*, 2*b*, are folded when the clasp is in the closed position. The two parallel lateral walls 2*c*1, 2*c*2 of this cover 24 comprise respective bores 4, facing one another in pairs and which are intended to accept a pivot pin for the adjusting link elements, as will be detailed hereinafter. The two parallel lateral walls 2*c*1, 2*c*2 of this cover 24 may also comprise two series of respective bores 4, facing one another in pairs so as to allow a conventional initial adjustment, as explained hereinabove.

The device for adjusting the length of the bracelet according to this embodiment of the invention is therefore arranged at the second end 1*b* of the bracelet, at least partially inside the cover 24 of a clasp. It comprises first of all a pivot pin for the adjusting link elements 23, 23' which are arranged under the cover 24 of the clasp. These same adjusting link elements 23, 23' are connected by a connecting pin 26 about which an end link element 25 present at the end 1*b* of the bracelet 1 is mounted with the ability to rotate.

Figure 2:
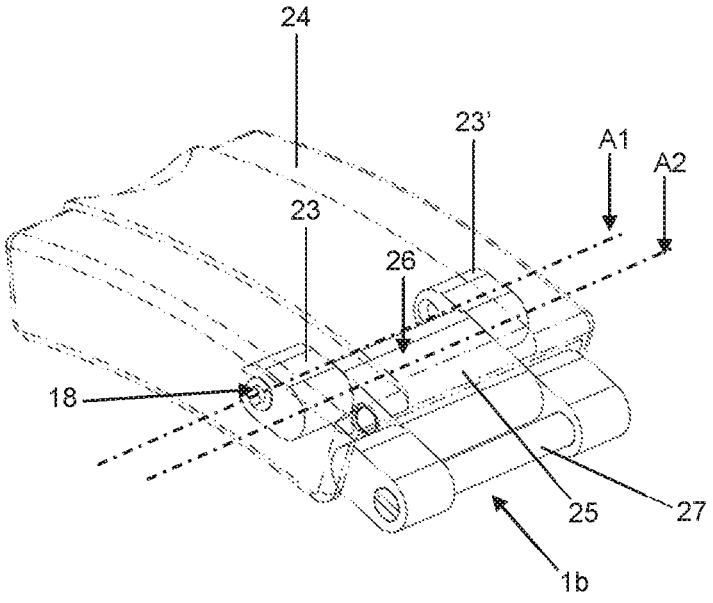
FIG. 2 depicts a perspective view of the clasp in the region of the device for adjusting the length of the bracelet in the long configuration, according to the embodiment of the invention.

FIG. 2 illustrates this arrangement at the end 1*b* of the bracelet in the long configuration. The adjusting link elements 23, 23' are positioned in such a way that the connecting pin 26 is oriented towards the outside of the cover 24 of the clasp with respect to a first axis A1 about which the adjusting link elements 23, 23' are articulated. The end link element 25 extends between this connecting pin 26 by which it is connected at its first end to two lateral adjusting link elements 23, 23', and another pin 27 towards its second end, to which the rest of the bracelet, notably a bracelet band is connected.

Figure 3:
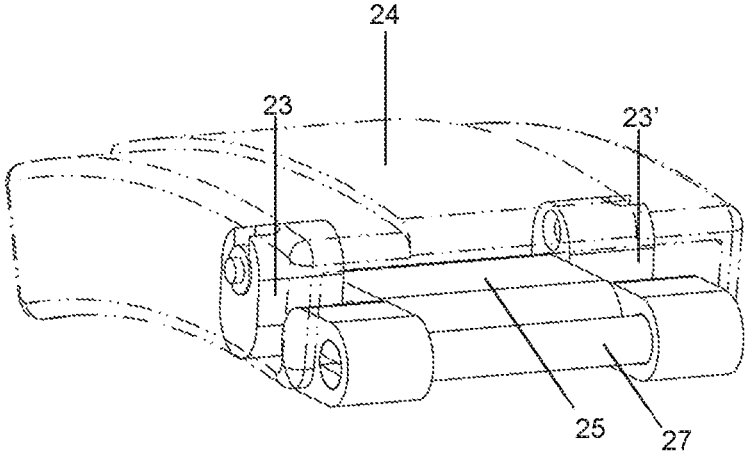
FIG. 3 depicts a perspective view of the clasp in the region of the device for adjusting the length of the bracelet in the actuation configuration for adjustment thereof according to the embodiment of the invention.

FIG. 3 illustrates the same arrangement during the course of actuation, in order notably to pass from the previous long configuration to the short configuration. To do that, the adjusting link elements 23, 23' are actuated to make them rotate about the first axis A1. This rotation makes the connecting pin 26 pivot about this first axis A1, towards the inside of the cover of the clasp, driving the end link element 25 towards the inside of the cover, at the same time inducing a reduction in the length of the bracelet 1. This rotation of the adjusting link elements 23, 23' is continued over approximately half a turn, until the short configuration is reached.

The bracelet length adjustment device according to this embodiment of the invention requires implementation of a first function of articulating the adjusting link elements 23, 23', and a second function of elastic fastening allowing the aforementioned short configuration to be maintained in a stable manner, in order to fasten together the end link element 25 and the adjusting link elements 23, 23', as will be detailed hereinafter.

Figure 4:
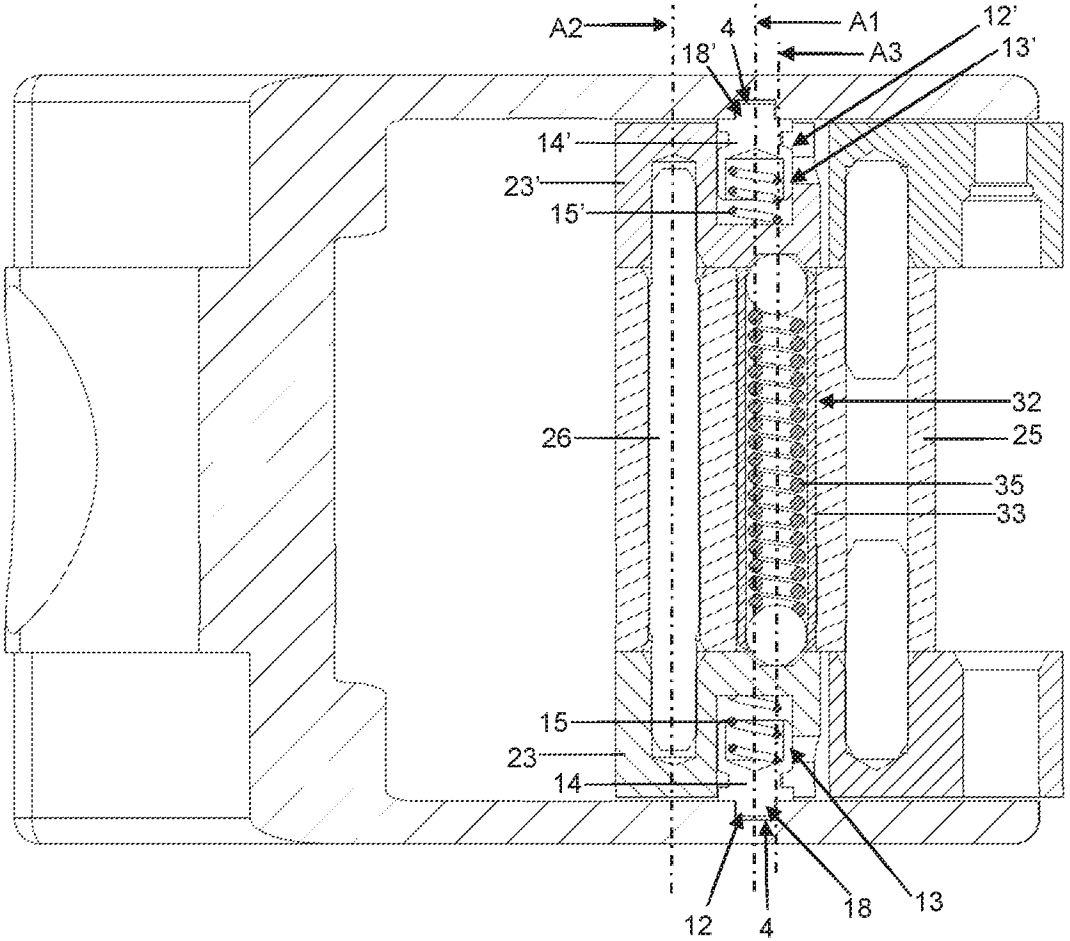
FIG. 4 depicts a view in section on a longitudinal plane of the clasp in the region of the device for adjusting the length of the bracelet in the short configuration according to the embodiment of the invention.
Figure 5:
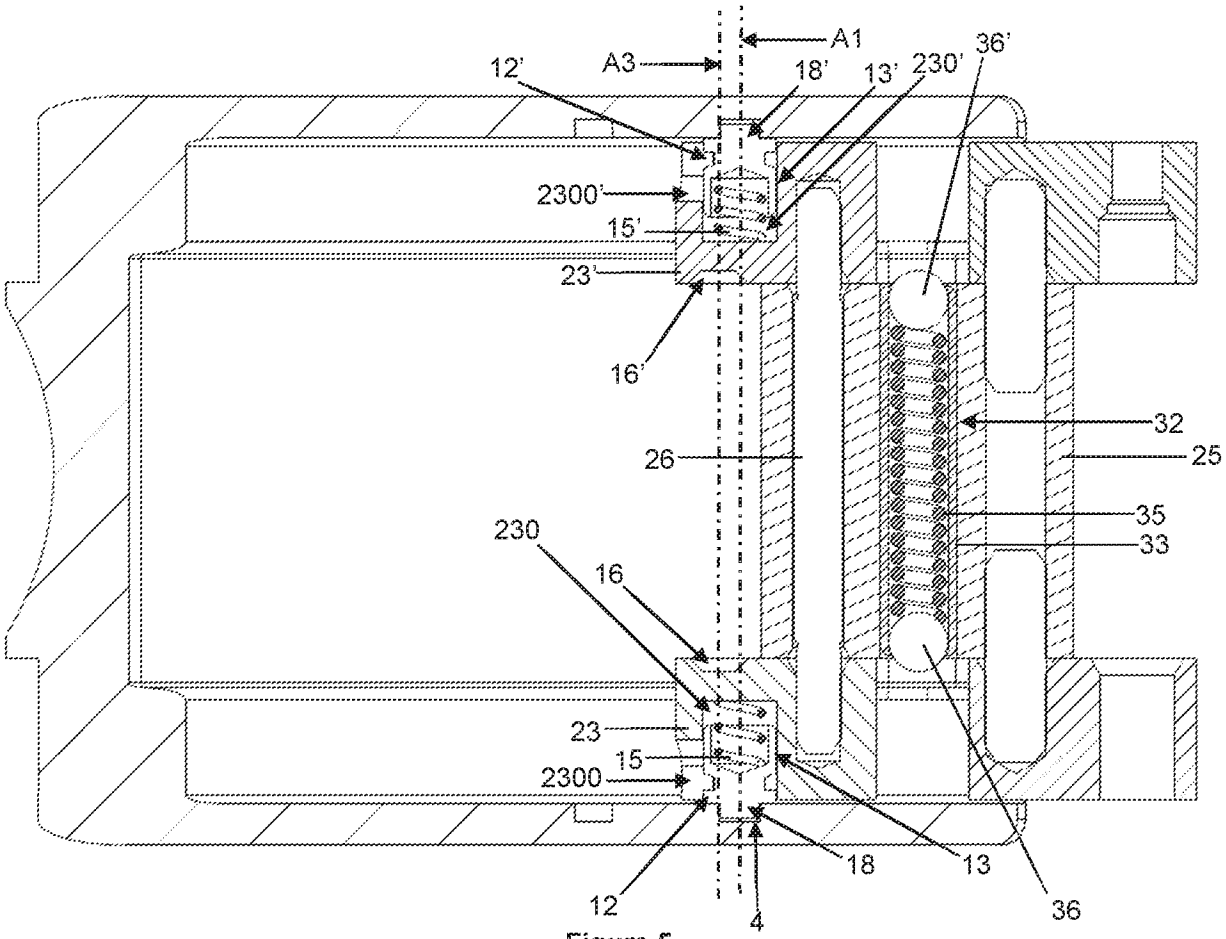
FIG. 5 depicts a view in section on a longitudinal plane of the clasp in the region of the device for adjusting the length of the bracelet in the long configuration according to the embodiment of the invention.
Figure 6:
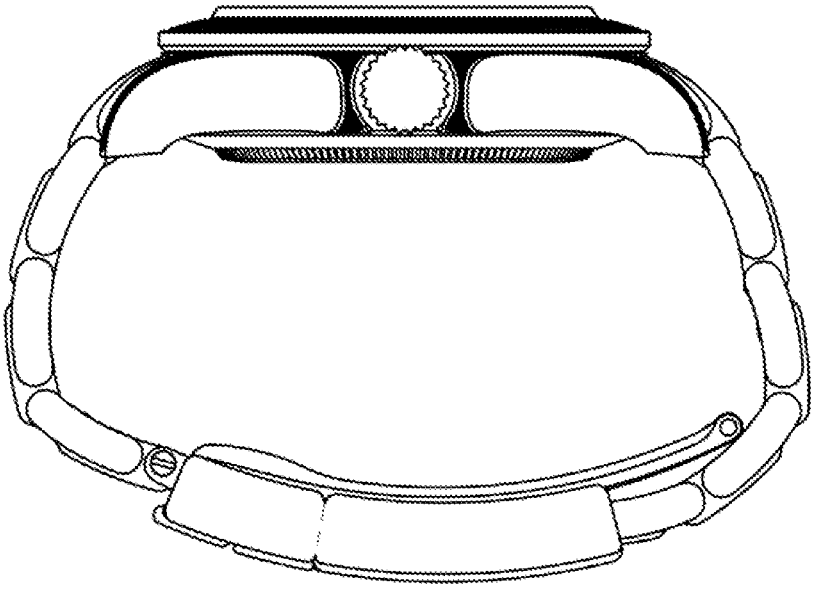
FIG. 6 depicts a schematic view of a wristwatch having a bracelet and including a device for adjusting the length of the bracelet according to an embodiment of the invention.

FIGS. 4 and 5 depict the arrangement of the bracelet length adjustment device in a view in section on a longitudinal transverse plane in the region of the first axis A1 of the bracelet length adjustment device.

The bracelet length adjustment device comprises first of all a substantially cylindrical bar 12, 12', arranged within each adjusting link element 23, 23', to form a guidance device for each link element, notably to form a device for guiding the rotation of each link element. Each bar 12, 12' is identical in this instance and symmetrically arranged on each side of the clasp, within each laterally positioned adjusting link element 23, 23', notably within bores 230, 230' of each adjusting link element 23, 23'.

The bar 12 extends transversely, about the first axis A1. It comprises a hollow pin 14 which comprises a first end forming a stud 18 positioned in a bore 4 of a lateral wall 2*c*1 of the cover 24 of the clasp. The pin 14 comprises a portion towards its second end, the peripheral surface 13 of which forms a guide surface for guiding the pivoting of the adjusting link element 23. The adjusting link element 23 is thus able to rotate about the first axis A1 relative to the clasp 24 and this rotation is guided by the bar 12, particularly the peripheral surface 13 of the pin 14. A retaining spring 15, notably a helical retaining spring 15, in the compressed configuration, is housed in a bore of the pin 14, which bore is formed in the region of the second end of the pin 14. It extends in the transverse direction and comprises a first end collaborating with the pin and a second end collaborating with the adjusting link element 23. This helical retaining spring 15 makes it possible to achieve a dissociable guide connection of the link element 23 relative to the cover 24. More particularly, it makes it possible to use a retractable pin 14, the stud 18 of which can be retracted out of the bore 4 of the cover 24, for example using a dedicated tool capable of acting on the pin 14 through an opening 2300 in the link element 23 during an operation of reconfiguring the bracelet. Moreover, this helical retaining spring 15 performs a function of retaining the adjusting link element 23 relative to the clasp 24, limits its movements, such as vibrations, which could exist as a result of construction clearances.

Furthermore, the bracelet length adjustment device comprises a bar 32, arranged within the end link element 25, to form an elastic fastening device. The bar 32 here extends transversely across the entire width of the end link element 25, in a bore provided for that purpose. It may, for example, be driven into a bore of the end link element 25. The bar 32 comprises a hollow pin 33 which incorporates a helical spring 35 in a preloaded configuration. This helical spring 35 collaborates with two balls 36, 36' positioned at the two ends of the pin 33, positioned partly within the hollow volume of the pin 33, such that they can move, and protruding out from the pin 33, at each lateral end of the end link element 25. Observation: the balls 36, 36' may be replaced by blocks or any other component the geometry of which is suited to constituting an appropriate interface between a spring and a notch. The positions of the balls 36, 36' are delimited by stops formed by the pin 33 in the region of each of its ends. Thus, the balls 36, 36' may be positioned to protrude out from the pin 33 without as a result leaving their housing within the hollow volume of the pin 33.

FIG. 4 depicts the clasp in the short configuration. In this configuration, the two balls 36, 36' of the end link element 25 are housed in a respective notch 16, 16' formed in each lateral wall of the adjusting link elements 23, 23'. These notches 16, 16' may for example take the form of a cutout delimited by one or more flanks that are inclined with respect to the lateral walls of the adjusting link elements 23, 23'. The balls 36, 36' are pushed back slightly by the notches 16, 16' towards the inside of the bar 32 against the force of the helical spring 35 which thus applies a retaining force and keeps the end link element 25 and the adjusting link elements 23, 23' stably fastened. Observation: the helical retaining springs 15, 15' of the bars 12, 12' apply pressure to the adjusting link elements 23, 23' that has a tendency to push the notches 16, 16' back against the balls 36, 36', inducing an additional elastic fastening effect. However, these helical retaining springs 15, 15' are optional, and the elastic fastening function could be achieved satisfactorily without them.

Actuation of the bracelet length adjustment device in order to change the bracelet from its short configuration depicted in FIG. 4 to its long configuration depicted in FIG. 5, comprises an initial phase of releasing the fastening link element 25 through a force of predetermined magnitude applied by the user in order to overcome the forces of attachment of the link elements 23, 25 in the fastened position. This force causes the balls 36, 36' to move inside the bore of the end link element 25 against the force of the helical spring 35 which is compressed. Next, when this release is achieved, the user causes the adjusting link elements 23 to pivot about the first axis A1 until the connecting pin 26 between the adjusting link elements 23 and the end link element 25 has achieved approximately half a turn about the first axis A1.

The two figures, FIGS. 4 and 5, illustrate that the length of the bracelet can be adjusted by an amount corresponding to more or less twice the distance between the centre of the connecting pin 26 and the first axis A1, between the two, short and long, configurations described hereinabove.

In this solution, it is noted that, in the short position, the connecting pin 26 extends along a second transverse axis A2, parallel to the first axis A1. In addition, the notches 16, 16' of the respective lateral walls of the adjusting link elements 23, 23' are arranged around a third transverse axis A3 passing through their centre. This third transverse axis A3 is slightly offset from the first axis A1 about which the pivoting of these adjusting link elements 23 is arranged. The third axis A3 is therefore distinct from the first axis A1, not aligned with the first axis A1. According to the embodiment, this offsetting of the two axes A1 and A3 is of the order of 0.5 mm, or is even comprised between 0.1 and 2 mm inclusive.

In addition, in the short configuration illustrated in FIG. 4, the fastening device arranged within the end link element 25 collaborates with the notches 16, 16' and also extends transversely along the third axis A3. In this short configuration it may be noted that this third axis A3 is arranged on the outward side of the clasp 24 relative to the first axis A1, unlike the second axis A2 about which is arranged the connecting pin 26 between the adjusting link elements 23 and the end link element 25. As in the prior art, construction constraints dictate a minimal distance between the axes A3 and A2 in order to incorporate the parallel arrangement of the connecting pin 26 on the one hand and of the fastening device, notably the bar 32, on the other. Because the third axis A3 is not aligned with the first axis A1, but presents an offset towards the outside of the cover 24 in the short configuration of the bracelet, the second axis A2 is closer to the first axis A1 than in a solution in which the two axes A1, A3 were aligned. It should therefore be emphasized that the embodiment relies on three distinct axes A1, A2, A3. These three axes A1, A2, A3 are parallel according to the embodiment. Finally, the axis A3 is able to rotate around the axis A1 between the two, long and short, configurations. It is always distinct from the first axis A1, in the two configurations. It is likewise distinct from the connecting pin 26. In particular, it is distinct from the second axis A2, and therefore from the connecting pin 26, in the short configuration.

Thus, this off-centring or offsetting of axes A1, A3 allows the connecting pin 26 of the end link element 25 of the bracelet to be brought closer to the axis of rotation of the adjusting link elements 23, in comparison with solutions of the prior art, thereby reducing the scale of length adjustment offered by this solution. It is thus possible to achieve an adjustment length of less than or equal to 4 mm, or even less than or equal to 3 mm.

As is clear from the foregoing description, the bracelet length adjustment device notably combines two distinct devices, for guidance and for fastening, respectively. The guidance device comprises the bar 12 and, more specifically, at least part of the peripheral surface 13 of the pin 14, as well as possibly the first end of the pin 14. The fastening device notably comprises the bar 32 which comprises the pin 33, the helical spring 35 and the balls 36, 36'. The two guidance and fastening functions are thus performed independently of one another.

As is clear from the foregoing description, the independence of the guidance and fastening functions is obtained through physical separation of components performing these two functions. Specifically, such components are distinct, which means that different and optimized materials can be chosen for performing each function, and that each function can be performed without suffering the influence of the components used for achieving the other function.

Thus, the elastic fastening function relies on elastic deformation of at least one spring component, independently of the guidance device, which means to say that this deformation has no impact on the components contributing to the guidance function. That allows the elastic fastening function to be performed reliably and repeatably over time, independently of any potential variations in the guidance device.

To complement this, the elastic fastening function is also independent of the materials used for the adjusting link elements and the end link element. The retaining force is defined only by the elastic deformation of the spring 35, with no risk of plastic deformation of the notch or notches, nor any risk of causing the bar 12 of the guidance device to flex. Thus, the retaining force generated by the fastening function is constant over time, whatever the bracelet used. By way of example, the link elements of the bracelet collaborating with the guidance and fastening system, notably the adjusting link element or elements and the end link element may be made of steel grade 904L, of gold, or alternatively of platinum.

By way of example, the bar 12 of the guidance device may be in a material of the steel grade 904L type, or in gold. The springs 15, 35 may be in a spring material of Nivaflex® type, or alternatively in a superelastic alloy of nickel and titanium, such as Nitinol.

In addition, the two guidance and fastening devices of the bracelet length adjustment device are combined with one another in such a way as to form a compact device of minimal bulkiness and which does not detract from the aesthetic appearance of the clasp or of the bracelet. This low bulkiness stems notably from the slight offset thereof in the fastening position, the off-centring (between the axes A1, A3) being less than or equal to 2 mm. They also can easily be assembled and incorporated into the bracelet.

Finally, the invention relies therefore on the optimal arrangement of an elastic fastening device, such as combined with a guidance device, in order to obtain a compact assembly that makes it possible to define improved performance and improved aesthetic results by optimizing, notably by minimizing, the amount of bracelet length adjustment.

Naturally, the foregoing arrangements have been described by way of exemplary embodiments, and other architectures are conceivable without departing from the scope of the invention. Notably, the guidance and/or fastening devices could exhibit other geometries. For example, it is possible for them not to exhibit axial symmetry. These two devices may be combined in an arrangement positioned within one and the same first element, for example one first guide link element. For example, the bar 32 of the fastening device could be arranged within an adjusting link element, comprising a ball collaborating elastically with a single notch arranged in a flank of the end link element of the bracelet. Furthermore, one or two guidance and fastening devices have been used with two adjusting link elements: as an alternative, a different number of guidance and/or fastening devices could be used, as could a different number of adjusting link elements.

In addition, the embodiment proposes additional adjustment, by way of several bores 4 arranged longitudinally in the cover 24, all able to accommodate the first axis A1 of rotation of the adjusting link elements. Thus, the choice of fixing bores for the adjusting link elements forms a first length adjustment, that complements the comfort adjustment described hereinabove. In order to make the longitudinal adjustment of the adjusting link elements easier, in the various bores or any other housing provided, the vertical walls may comprise one or more guide ways, and the stud of the adjusting link elements may collaborate with one or more shoes arranged in these guide ways to encourage the longitudinal sliding of the adjusting link elements. In such a case, the guidance device arranged within a link element may perform the function of guiding the pivoting of the link element, as explained hereinabove, and the second function of longitudinal guidance of the link element relative to the clasp.

In all the embodiments, what is meant by an elastic fastening device is a device which comprises at least one spring element, which deforms in order to fasten one or more other component(s), in a manner that is elastically reversible. This elastic fastening may be performed against a bracelet link element, the said link element contributing passively (without deforming) to the fastening. This elastic fastening may be performed against a fixed part of a bracelet or of a clasp.

Furthermore, what is meant by a guidance device is a device provided with at least one means, notably a surface, for guiding one component with respect to a distinct component. This guidance may be a rotation and/or a movement along a groove. It may be achieved using a bracelet link element, particularly an adjusting link element, and/or a clasp.

Advantageously, the guidance and fastening arrangement is associated with a device for adjusting the length of a bracelet within a clasp, as described hereinabove. Advantageously, an adjusting link element and possibly at least part of an end link element are located under a cover formed by the clasp, this mechanism thus remaining hidden. The clasp may be of various types, having two or three deployment leaves. As an alternative, the guidance and fastening arrangement could simply be associated with one leaf of a clasp and be used to articulate and fasten this leaf. The guidance and fastening arrangement may thus be implemented for any system associated with a bracelet requiring variations in geometry. As a further alternative, the guidance and fastening arrangement could be associated with a bracelet link element or link, whatever its position relative to the clasp.

The invention also relates to a bracelet and/or a clasp and/or a wristwatch incorporating at least one length adjusting device as described hereinabove.

The invention claimed is:

1. A device for adjusting a length of a bracelet, wherein the device comprises:

at least one adjusting link element mounted with an ability to rotate about a first axis, and a connecting pin, wherein the adjusting link element is connected to an end link element of the bracelet by the connecting pin, so that the end link element can occupy two positions, each of the two positions corresponding respectively to a short configuration and a long configuration of the length of the bracelet, and wherein the device comprises an elastic fastening device so as to elastically fasten together the at least one adjusting link element and the end link element in the short configuration, where in the short configuration, the elastic fastening device is arranged around a third axis not aligned with the first axis and distinct from the connecting pin.

2. The device for adjusting the length of the bracelet according to claim 1, wherein the first axis and the third axis are parallel.

3. The device for adjusting the length of the bracelet according to claim 1, wherein a distance between the first and third axes is less than or equal to 2 mm and greater than or equal to 0.1 mm.

4. The device for adjusting the length of the bracelet according to claim 1, wherein the device is able to perform a length adjustment less than or equal to 4 mm.

5. The device for adjusting the length of the bracelet according to claim 4, wherein the device is able to perform the length adjustment less than or equal to 3 mm.

6. The device for adjusting the length of the bracelet according to claim 1, wherein the device comprises a device for guiding the at least one adjusting link element comprising a bar arranged within the at least one adjusting link element and comprising a guide for pivoting of the adjusting link element.

7. The device for adjusting the length of the bracelet according to claim 6, wherein the bar comprises a pin and a spring housed between the pin and the at least one adjusting link element.

8. The device for adjusting the length of the bracelet according to claim 7, wherein the pin or the bar comprises a stud mounted in a bore of a clasp cover about the first axis.

9. The device for adjusting the length of the bracelet according to claim 8, wherein the stud is mounted in the bore of the clasp cover with the ability to rotate in the bore of the clasp cover about the first axis.

10. The device for adjusting the length of the bracelet according claim 1, wherein the elastic fastening device comprises a bar comprising a pin and at least one ball able to move parallel to the third axis of the bar under an effect of a preloaded spring housed in a hollow volume of the pin, the ball being able to project from the pin.

11. The device for adjusting the length of the bracelet according to claim 10, wherein the at least one ball collaborates with a notch in the short configuration, so as to fasten the end link element to the adjusting link element.

12. The device for adjusting the length of the bracelet according to claim 11, wherein the notch is arranged on a lateral wall of the adjusting link element or of the end link element.

13. The device for adjusting the length of the bracelet according to claim 1, wherein the device comprises a guidance device arranged inside the adjusting link element at a level of the first axis and the elastic fastening device arranged within the end link element at a level of the third axis in the short configuration.

14. The device for adjusting the length of the bracelet according to claim 1, wherein the third axis is arranged towards an outside of a cover with respect to the first axis when the bracelet is in the short configuration.

15. The device for adjusting the length of the bracelet according to claim 1, wherein the device comprises two lateral adjusting link elements each comprising a pivoting-guidance device and the end link element positioned between the two lateral adjusting link elements and fastening elastically on each of the adjusting link elements in the short configuration.

16. The device for adjusting the length of the bracelet according to claim 1, wherein the device comprises a guidance device and the elastic fastening device, wherein the guidance device and the elastic fastening device are able to perform their respective functions independently of one another.

17. The device for adjusting the length of the bracelet according to claim 1, wherein the device comprises a guidance device and the elastic fastening device, wherein the guidance device and the elastic fastening device are formed at least in part of distinct components.

18. A deployment clasp for bracelet, wherein the clasp comprises at least one bracelet length adjustment device according to claim 1.

19. A bracelet, wherein the bracelet comprises the deployment clasp according to claim 18.

20. A wristwatch, wherein the wristwatch comprises at least one bracelet according to claim 19.

* * * * *